US009736565B2

(12) United States Patent
Lee

(10) Patent No.: US 9,736,565 B2
(45) Date of Patent: Aug. 15, 2017

(54) PROTECTION ASSEMBLY FOR EAR-MOUNTED SOUND-OUTPUT DEVICE

(71) Applicant: Jonggi Lee, Gwangju (KR)

(72) Inventor: Jonggi Lee, Gwangju (KR)

( * ) Notice: Subject to any disclaimer, the term of this patent is extended or adjusted under 35 U.S.C. 154(b) by 0 days.

(21) Appl. No.: 15/210,384

(22) Filed: Jul. 14, 2016

(65) Prior Publication Data

US 2017/0055062 A1 Feb. 23, 2017

(30) Foreign Application Priority Data

Aug. 19, 2015 (KR) ..... 10-2015-0117000

(51) Int. Cl.
*H04R 25/00* (2006.01)
*H04R 1/10* (2006.01)
*H04R 5/033* (2006.01)

(52) U.S. Cl.
CPC ..... *H04R 1/1033* (2013.01); *H04R 1/1016* (2013.01); *H04R 1/1058* (2013.01); *H04R 1/1066* (2013.01); *H04R 5/033* (2013.01); *H04R 2201/109* (2013.01); *H04R 2420/07* (2013.01)

(58) Field of Classification Search
CPC .. H04R 1/1016; H04R 1/1033; H04R 1/1041; H04R 1/1058; H04R 1/1066; H04R 5/033; H04R 5/0335; H04R 2201/109; H04R 2420/07; H04M 1/05; H04M 1/15
USPC ..... 381/309, 311, 370, 374, 376, 380, 384; 379/430, 438, 420.01, 420.02; 455/344, 455/569.1, 575.1, 575.8
See application file for complete search history.

(56) References Cited

U.S. PATENT DOCUMENTS 2,641,327 A * 6/1953 Balmer ..... H04R 1/105 181/129
6,721,579 B2 * 4/2004 Liu ..... H04M 1/6058 379/373.02
2011/0110552 A1 * 5/2011 Pang ..... H04R 1/1033 381/374

* cited by examiner

*Primary Examiner* — Huyen D Le
(74) *Attorney, Agent, or Firm* — KORUS Patent, LLC; Seong Il Jeong

(57) ABSTRACT

A protection assembly for an ear-mounted sound-output device, the assembly comprising: one pair of sound-output unit covers, each cover having an inner space formed therein and a first open end to allow a sound-output unit of the ear-mounted sound-output device to be received in the inner space, and a coupling hole defined at a second closed end of the cover, wherein the first and second ends are opposite to each other; and one pair of connection lines, each line coupled to each of one pair of the ear-mounted sound-output unit covers at the second end of the cover, each line having a first end passing through the hole, each line having a stopper received in the inner space at the first of the line, each line having a loop at a second end of the line to allow a sound-transfer cable connected the sound-output unit to slidably pass through the loop.

10 Claims, 5 Drawing Sheets

PROTECTION ASSEMBLY FOR EAR-MOUNTED SOUND-OUTPUT DEVICE

CROSS-REFERENCE TO RELATED APPLICATION

This application claims the benefit of Korea Patent Application No. 10-2015-0117000, filed on Aug. 19, 2015, the entire content of which is incorporated herein by reference for all purposes as if fully set forth herein.

BACKGROUND

Field of the Present Disclosure

The present disclosure relates to a protection assembly for an ear-mounted sound-output device and to a neck-mounted device comprising an ear-mounted sound-output device a protection assembly for the ear-mounted sound-output device.

Discussion of the Related Art

An ear-mounted sound-output device may have sound-output units and sound transfer cables coupled to the units respectively. As an approach to suppress a contaminant from entering into the sound-output unit, two following patent documents are disclosed: Korean patent number 10-1099269 and Korean patent number 10-0827079.

The first document discloses (10-1099269) an earphone capable of preventing the damage of the connection part of a speaker unit and a single cord is provided to install a speaker unit inside the cover without a cord cover by forming the size of an open cover. A cover type earphone includes a speaker unit outputting sound source, a single cord connected to the speaker unit, and a dual cord connected to the single cord. The speaker unit or the single cord is installed in inside. A code cover is combined in the lower side of a hinge unit of opening and closing the cover. The speaker unit is composed of a speaker outputting the sound source and a speaker support stand.

The second document discloses (10-0827079) discloses an earphone device for a portable terminal is provided to adjust a length of a cable and to prevent twist of the cable by including a fixing member and a combining member on the cable. An earphone device for a portable terminal comprises a main body, an earphone, a fixing member, and a combining member. The main body is connected with the portable terminal. The earphone includes a pair of ear-speakers and a connecting terminal connected by a cable. The fixing member is positioned and fixed on the cable. The cable is bended and folded with regard to the fixing member as a center. The combining member wraps the bended and folded cable and slides along the cable. When the ear-speakers are fixed to the main body, the cables between the fixing member and the combining member function as a strap of the portable terminal.

SUMMARY

In an aspect of the present disclosure, there is provided a protection assembly for an ear-mounted sound-output device, the assembly comprising: one pair of sound-output unit covers, each cover having an inner space formed therein and a first open end to allow a sound-output unit of the ear-mounted sound-output device to be received in the inner space, and a coupling hole defined at a second closed end of the cover, wherein the first and second ends are opposite to each other; and one pair of connection lines, each line coupled to each of one pair of the ear-mounted sound-output unit covers at the second end of the cover, each line having a first end passing through the hole, each line having a stopper received in the inner space at the first of the line, each line having a loop at a second end of the line to allow a sound-transfer cable connected the sound-output unit to slidably pass through the loop, wherein the first and second ends of the line are opposite to each other, wherein the assembly has a loop fixing member coupled to the line, wherein the loop fixing member is configured to fix the loop to the sound-transfer cable when the loop slides along and around the sound-transfer cable to a predetermined position of the sound-transfer cable.

In one embodiment, one of the sound-output unit covers has a coupling groove formed thereon at the first end thereof, and the other of the sound-output unit covers has a coupling protrusion formed thereon at the first end thereof, wherein the coupling protrusion is engageable with the coupling groove to allow a firm connection between the covers when the covers are removed from the sound-output units.

In one embodiment, a protrusion is formed on an inner side face of each of the sound-output unit covers to be engaged with each of the sound-output units to allow each sound-output unit to be immobilized in the inner space.

In one embodiment, the loop fixing member is formed of a tube structure to allow the connection line to pass through the tube structure.

In one embodiment, the connection line tightly passes through the tube structure, wherein When the tube structure is forced to move toward the loop to allow the loop to tightly contact the sound-transfer cable, the loop is fixed to the cable.

In an aspect of the present disclosure, there is provided a neck-mounted device comprising; an ear-mounted sound-output device having sound-output units and sound transfer cables coupled to the units respectively; and a protection assembly for the ear-mounted sound-output device, the assembly comprising: one pair of sound-output unit covers, each cover having an inner space formed therein and a first open end to allow the sound-output unit of the ear-mounted sound-output device to be received in the inner space, and a coupling hole defined at a second closed end of the cover, wherein the first and second ends are opposite to each other; and one pair of connection lines, each line coupled to each of one pair of the ear-mounted sound-output unit covers at the second end of the cover, each line having a first end passing through the hole, each line having a stopper received in the inner space at the first of the line, each line having a loop at a second end of the line to allow a sound-transfer cable connected the sound-output unit to slidably pass through the loop, wherein the first and second ends of the line are opposite to each other, wherein the assembly has a loop fixing member coupled to the line, wherein the loop fixing member is configured to fix the loop to the sound-transfer cable when the loop slides along and around the sound-transfer cable to a predetermined position of the sound-transfer cable.

BRIEF DESCRIPTIONS OF THE DRAWINGS

The accompanying drawings included to provide a further understanding of the present disclosure illustrate embodiments of the present disclosure.

Figure 1:
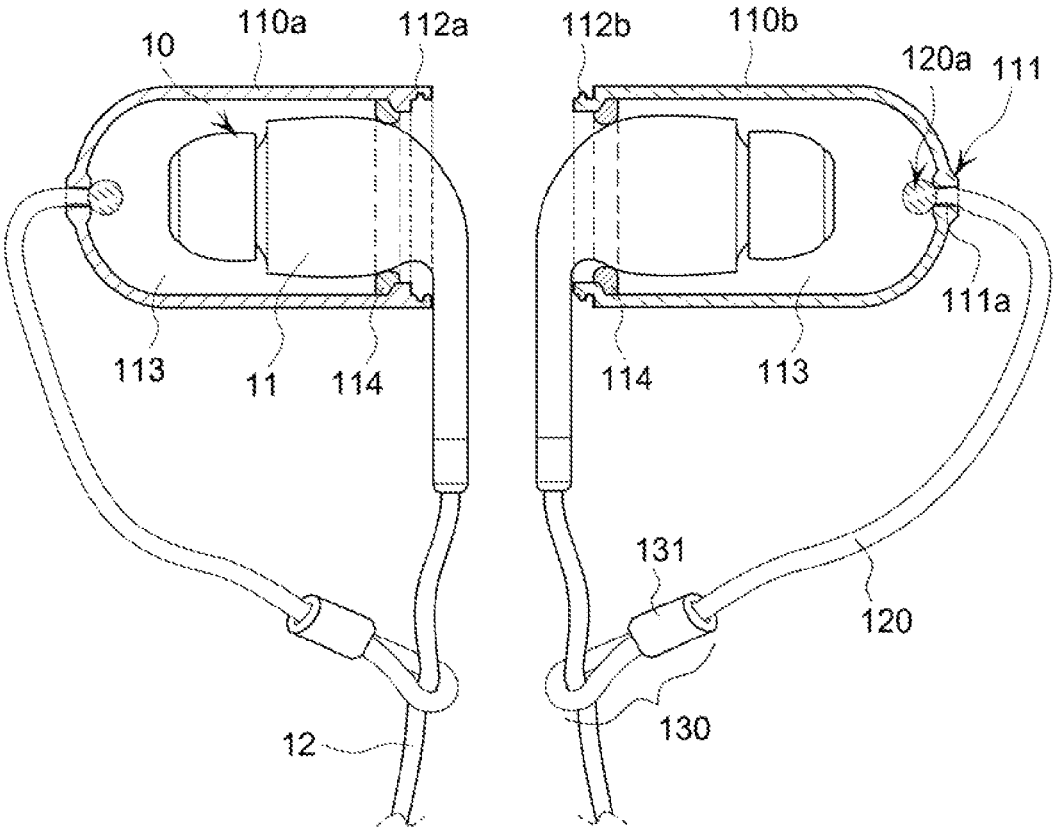
FIG. 1 shows a protection assembly for protecting a sound-output unit of an ear-mounted sound-output device in accordance with the present disclosure wherein the sound-output unit is received in a cover of the protection assembly.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present disclosure refers to "one or more embodiments of the present disclosure."

Hereinafter, embodiments of the present disclosure will be described in details with reference to attached drawings.

Figure 2:
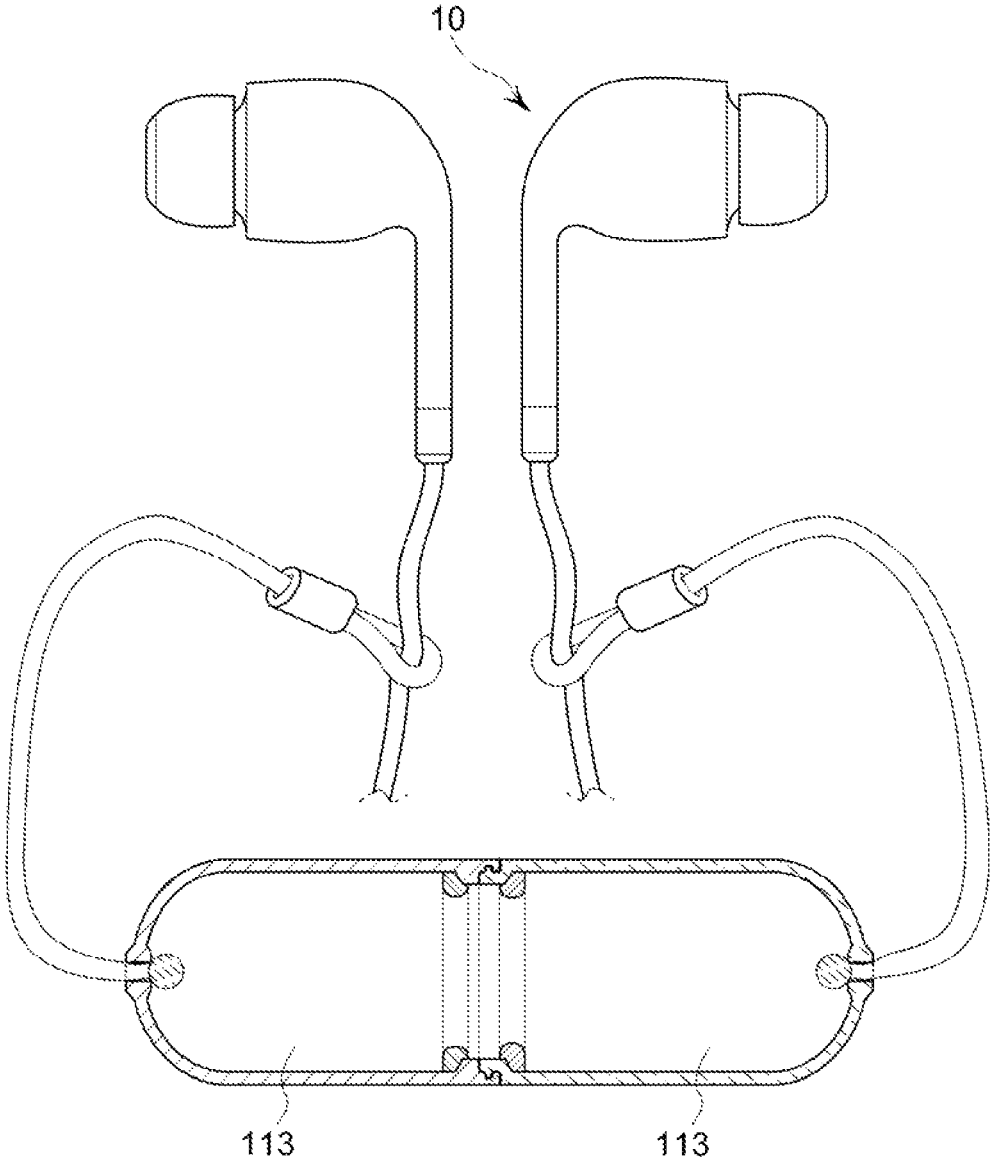
FIG. 2 shows a protection assembly for protecting a sound-output unit of an ear-mounted sound-output device in accordance with the present disclosure wherein the sound-output unit is removed from a cover of the protection assembly, and one pair of the covers are engaged with each other.
Figure 3:
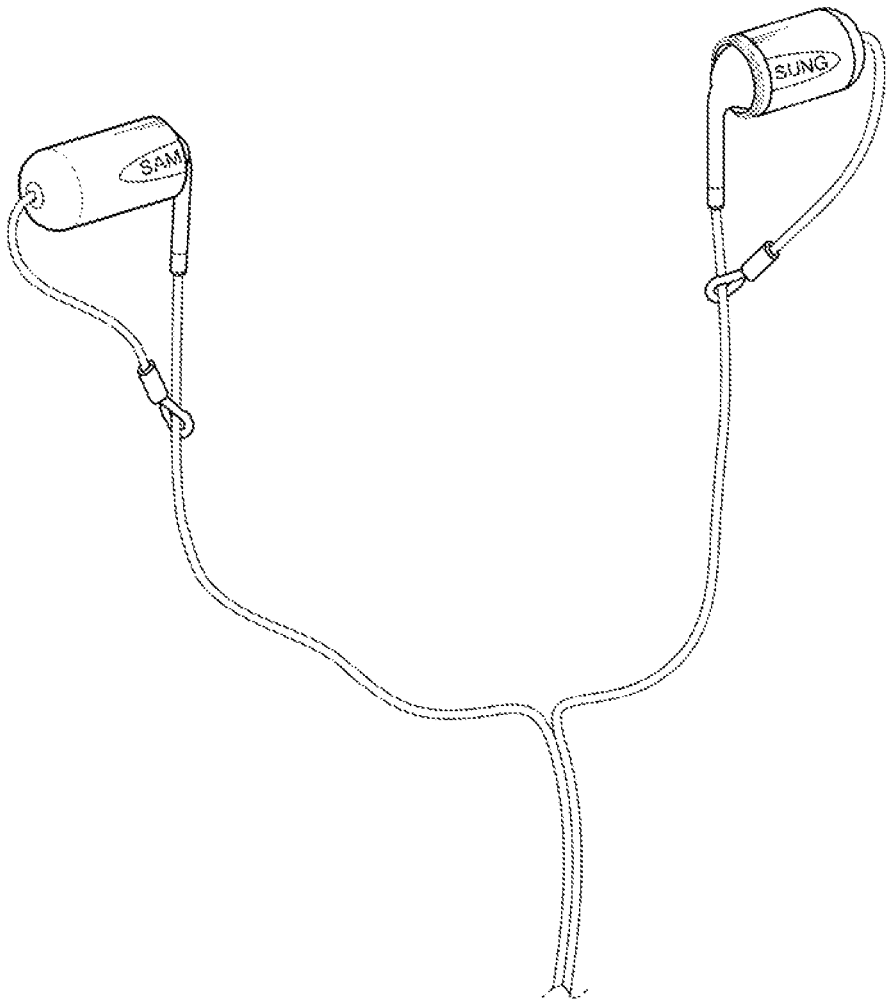
FIG. 3 shows one use example where a cover of a protection assembly for protecting a sound-output unit of an ear-mounted sound-output device in accordance with the present disclosure receives therein the sound-output unit.
Figure 4:
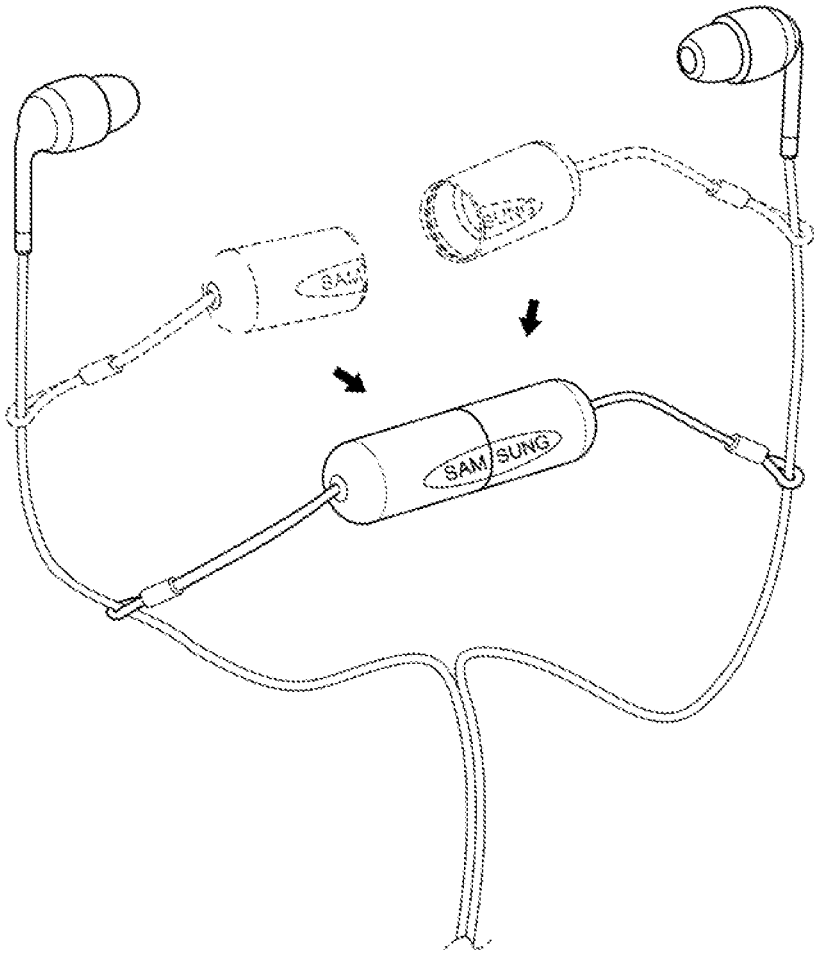
FIG. 4 shows one use example where a cover of a protection assembly for protecting a sound-output unit of an ear-mounted sound-output device in accordance with the present disclosure is removed from the sound-output unit, and one pair of the covers are engaged with each other.
Figure 5:
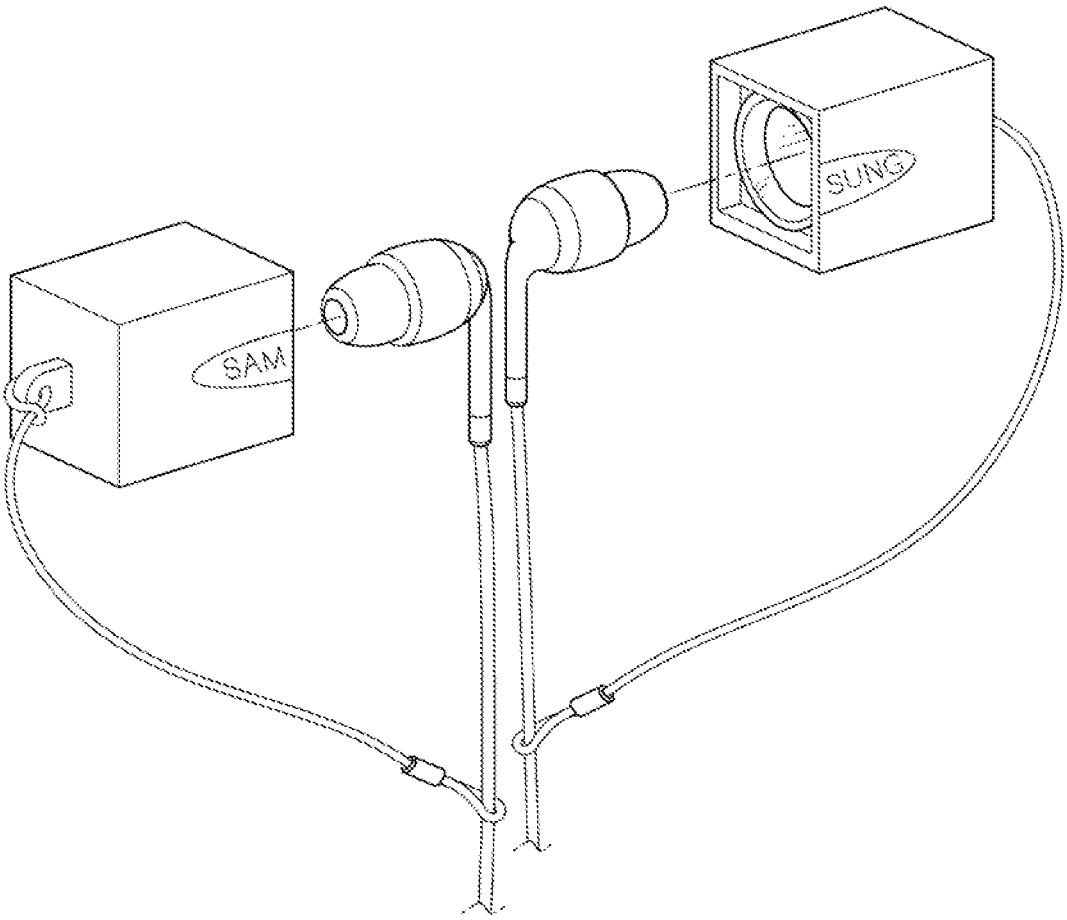
FIG. 5 shows another use example where a cover of a protection assembly for protecting a sound-output unit of an ear-mounted sound-output device in accordance with the present disclosure is removed from the sound-output unit.

FIG. 1 shows a protection assembly for protecting a sound-output unit of an ear-mounted sound-output device in accordance with the present disclosure wherein the sound-output unit is received in a cover of the protection assembly. FIG. 2 shows a protection assembly for protecting a sound-output unit of an ear-mounted sound-output device in accordance with the present disclosure wherein the sound-output unit is removed from a cover of the protection assembly, and one pair of the covers are engaged with each other. FIG. 3 shows one use example where a cover of a protection assembly for protecting a sound-output unit of an ear-mounted sound-output device in accordance with the present disclosure receives therein the sound-output unit. FIG. 4 shows one use example where a cover of a protection assembly for protecting a sound-output unit of an ear-mounted sound-output device in accordance with the present disclosure is removed from the sound-output unit, and one pair of the covers are engaged with each other. FIG. 5 shows another use example where a cover of a protection assembly for protecting a sound-output unit of an ear-mounted sound-output device in accordance with the present disclosure is removed from the sound-output unit A protection assembly for an ear-mounted sound-output device in accordance with the present disclosure may include one pair of sound-output unit covers 110*a*,110*b*, each cover having an inner space 113 formed therein and one open end to allow a sound-output unit 11 of the ear-mounted sound-output device 10 to be received in the inner space 113, and a coupling hole 111 defined at the other closed end of the cover; and one pair of connection lines 120, each line coupled to each of one pair of the ear-mounted sound-output unit cover, each line having one end passing through the coupling hole 111, each line having a stopper 120*a* at one end to be received in the inner space 113 and a loop 130 at the other end thereof to allow a sound-transfer cable 12 connected the sound-output unit to slidably pass through the loop.

In this connection, when the sound-output unit of the ear-mounted sound-output device is received in the inner space of each of one pair of the sound-output unit covers 110*a*, 110*b*, the cover may be configured such that the sound-output unit may be tightly-fitted into the inner space 113 of the cover to suppress a contaminant from entering into the inner space.

In use of the ear-mounted sound-output device, each of one pair of sound-output unit covers 110*a*, 110*b* may be removed from the sound-output unit 11 of the ear-mounted sound-output device 10 and one pair of sound-output unit covers 110*a*, 110*b* may be engaged with each other. For this, a diameter of one of a pair of sound-output unit covers 110*a*,110*b* is larger than that of the other thereof such that the latter cover is partially inserted into the former cover.

The connection line 120 may pass through the coupling hole 111 or 111*a* at one end to enable a connection between each of the sound-output unit cover 110*a*,110*b* and the coupling hole 111.

The ear-mounted sound-output device cover has a protrusion defining the coupling hole 111 therethrough. When the connection line 120 passes through the hole 111 or 111*a*, the protrusion may stop the movement of one end of the line 120.

In another embodiment of the present disclosure, the sound-output unit cover 110*a* may have a coupling groove 112*a* formed thereon at the open end side, while the sound-output unit cover 110*b* may have a coupling protrusion 112*b* formed thereon at the open end side. Thus, as shown in FIG. 2, when the covers are removed from the sound-output units, the coupling groove 112*a* may be engaged with the coupling protrusion 112*b* to allow a firm connection between the sound-output unit covers 110*a* and 110*b*.

Each of the sound-output unit covers may have a protrusion 114 formed at an inner side thereof to allow the outer face of the sound output unit of the ear-mounted sound-output device to be engaged with the protrusion 114 to prevent easy removal of the sound output unit from the sound-output unit cover.

The connection line 120 may have a loop fixing member 131 configured to fix the loop 130 to the sound-transfer cable 12 when the loop 130 slides along and around the sound-transfer cable 12 to a predetermined position of the sound-transfer cable 12.

In one example, the loop fixing member 131 may be formed of a tube structure to allow the body of the connection line to pass through the tube structure. The connection line 120 may tightly pass through the tube structure. When the tube structure is forced to move toward the loop to allow the loop to tightly contact the sound-transfer cable 12.

In use, the user may remove the sound-output unit covers 110*a* and 110*b* from the sound-output units 11 of the ear-mounted sound-output device 10 and the user may insert the sound-output units 11 into the ears of the user and then may engage the sound-output unit covers 110*a* and 110*b* with each other as shown in FIG. 2 and then may slide the loops 130 along the sound-transfer cable 12 of the ear-mounted sound-output device 10 to the tailored position of the cable 12 and may fix the loops 130 to the cable 12 and then may allow both the connection lines 120 to hang around the neck of the user to use the engaged covers as a neck decoration. In this case, the covers have the logo or trademark or characters marked thereon as shown in FIG. 4.

The sound-output unit cover may be made of a natural rubber or polyester elastomer (PE) or silicon or polyurethane (PU).

Although the ear-mounted sound-output unit cover has a cylindrical shape in FIG. 1, the present disclosure is not limited thereto. The ear-mounted sound-output unit cover has a polygonal shape in FIG. 5 as viewed from a top.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A protection assembly for an ear-mounted sound-output device, the assembly comprising:

one pair of sound-output unit covers, each cover having an inner space formed therein and a first open end to allow a sound-output unit of the ear-mounted sound-output device to be received in the inner space, and a coupling hole defined at a second closed end of the cover, wherein the first and second ends are opposite to each other; and one pair of connection lines, each line coupled to each of one pair of the ear-mounted sound-output unit covers at the second end of the cover, each line having a first end passing through the hole, each line having a stopper received in the inner space at the first end of the line, each line having a loop at a second end of the line to allow a sound-transfer cable connected the sound-output unit to slidably pass through the loop, wherein the first and second ends of the line are opposite to each other, wherein the assembly has a loop fixing member coupled to the line, wherein the loop fixing member is configured to fix the loop to the sound-transfer cable when the loop slides along and around the sound-transfer cable to a predetermined position of the sound-transfer cable.

2. The assembly of claim 1, wherein one of the sound-output unit covers has a coupling groove formed thereon at the first open end thereof, and the other of the sound-output unit covers has a coupling protrusion formed thereon at the first open end thereof, wherein the coupling protrusion is engageable with the coupling groove to allow a firm connection between the covers when the covers are removed from the sound-output units.

3. The assembly of claim 1, wherein a protrusion is formed on an inner side face of each of the sound-output unit covers to be engaged with each of the sound-output units to allow each sound-output unit to be immobilized in the inner space.

4. The assembly of claim 1, wherein the loop fixing member is formed of a tube structure to allow the connection line to pass through the tube structure.

5. The assembly of claim 4, wherein the connection line tightly passes through the tube structure, wherein When the tube structure is forced to move toward the loop to allow the loop to tightly contact the sound-transfer cable, the loop is fixed to the cable.

6. A neck-mounted device comprising:

an ear-mounted sound-output device having sound-output units and sound transfer cables coupled to the units respectively; and a protection assembly for the ear-mounted sound-output device, the assembly comprising:

one pair of sound-output unit covers, each cover having an inner space formed therein and a first open end to allow the sound-output unit of the ear-mounted sound-output device to be received in the inner space, and a coupling hole defined at a second closed end of the cover, wherein the first and second ends are opposite to each other; and one pair of connection lines, each line coupled to each of one pair of sound-output unit covers at the second end of the cover, each line having a first end passing through the hole, each line having a stopper received in the inner space at the first of the line, each line having a loop at a second end of the line to allow a sound-transfer cable connected the sound-output unit to slidably pass through the loop, wherein the first and second ends of the line are opposite to each other, wherein the assembly has a loop fixing member coupled to the line, wherein the loop fixing member is configured to fix the loop to the sound-transfer cable when the loop slides along and around the sound-transfer cable to a predetermined of the sound-transfer cable, wherein the covers removed from the sound units act as a neck decoration.

7. The device of claim 6, wherein one of the sound-output unit covers has a coupling groove formed thereon at the first open end thereof, and the other of the sound-output unit covers has a coupling protrusion formed thereon at the first open end thereof, wherein the coupling protrusion is engageable with the coupling groove to allow a firm connection between the covers when the covers are removed from the sound-output units.

8. The device of claim 6, wherein a protrusion is formed on an inner side face of each of the sound-output unit covers to be engaged with each of the sound-output units to allow each sound-output unit to be immobilized in the inner space.

9. The device of claim 6, wherein the loop fixing member is formed of a tube structure to allow the connection line to pass through the tube structure.

10. The device of claim 9, wherein the connection line tightly passes through the tube structure, wherein When the tube structure is forced to move toward the loop to allow the loop to tightly contact the sound-transfer cable, the loop is fixed to the cable.

* * * * *